US008444343B2

(12) United States Patent
McCue et al.

(10) Patent No.: US 8,444,343 B2
(45) Date of Patent: May 21, 2013

(54) IMPACT-ABSORBING ANCHORING ASSEMBLY FOR PROTECTIVE BARRIER

(75) Inventors: David S. McCue, Manchester, MA (US); Brent Hild, Belmont, MA (US); Teodoro A. Mesa, Lynn, MA (US); Thomas C. Fitch, Somerville, MA (US)

(73) Assignee: McCue Corporation, Salem, MA (US)

( * ) Notice: Subject to any disclaimer, the term of this patent is extended or adjusted under 35 U.S.C. 154(b) by 0 days.

(21) Appl. No.: 13/117,533

(22) Filed: May 27, 2011

(65) Prior Publication Data

US 2012/0301219 A1 Nov. 29, 2012

(51) Int. Cl.
*E01F 15/00* (2006.01)

(52) U.S. Cl.
USPC ..... 404/9; 404/10; 256/13.1

(58) Field of Classification Search
CPC ..... E01F 9/0122
USPC ..... 404/6, 9–11; 256/13.1
See application file for complete search history.

(56) References Cited

U.S. PATENT DOCUMENTS

| | | | | |
|---|---|---|---|---|
| 1,903,683 A | | 4/1933 | Nute | |
| 3,193,059 A | | 7/1965 | Wallerstein, Jr. | |
| 3,212,415 A | | 10/1965 | Byrd | |
| 4,106,879 A | * | 8/1978 | Diedershagen et al. | 404/10 |
| 4,636,108 A | * | 1/1987 | Duckett | 404/10 |
| 4,806,046 A | * | 2/1989 | Clark | 404/10 |
| 5,090,348 A | * | 2/1992 | Hugron | 116/63 P |
| 5,186,423 A | * | 2/1993 | Wakayama et al. | 248/160 |
| 5,205,236 A | | 4/1993 | Hughes | |
| 5,207,175 A | * | 5/1993 | Andonian | 116/209 |
| 5,354,144 A | * | 10/1994 | Lizakowski | 404/10 |
| 5,397,197 A | | 3/1995 | Beavers | |
| 5,503,496 A | * | 4/1996 | Voigt | 404/10 |
| 5,703,577 A | * | 12/1997 | Carter | 340/908 |
| 5,788,405 A | | 8/1998 | Beard | |
| 5,899,628 A | * | 5/1999 | Pei-Chi | 404/9 |
| 6,053,658 A | | 4/2000 | Gibson, Jr. | |

(Continued)

FOREIGN PATENT DOCUMENTS

| | | |
|---|---|---|
| AU | 752762 B2 | 3/1999 |
| CA | 658267 A | 2/1963 |

(Continued)

OTHER PUBLICATIONS

UKIPO Search Report for Great Britain Application No. GB1109538.7 dated Oct. 3, 2011, 3 pages.

*Primary Examiner* — Raymond W Addie
(74) *Attorney, Agent, or Firm* — Occhiuti Rohlicek & Tsao LLP

(57) ABSTRACT

A bollard assembly includes a bollard, and a load transfer member disposed in the bollard, and a shock absorber disposed within the load transfer member. A fastener extends through the load transfer member and shock absorber, and secures the bollard, load transfer member and shock absorber to a ground surface. The load transfer member adjoins the bollard so as to be disposed between the shock absorber and the bollard, and the load transfer member is configured so that when an impact force is applied to the bollard, the force is transferred from the bollard to the shock absorber via the load transfer member. The deflection is absorbed by the shock absorber so that the anchor remains undeformed and the ground remains undamaged. Moreover, due to the resilience of the shock absorber, the bollard and load transfer member are returned to a normal, upright orientation upon withdrawal of the impact load.

42 Claims, 4 Drawing Sheets

U.S. PATENT DOCUMENTS

| | | | | |
|---|---|---|---|---|
| 7,025,527 | B2 | 4/2006 | Mecham | |
| 7,052,201 | B2 | 5/2006 | Zivkovic | |
| 7,849,617 | B2 * | 12/2010 | Intagliata et al. | 40/608 |
| 7,901,156 | B2 | 3/2011 | McCue et al. | |

FOREIGN PATENT DOCUMENTS

| | | |
|---|---|---|
| JP | 02236306 A | 9/1990 |
| JP | 08-232219 | 9/1996 |
| KR | 10-0873011 | 12/2008 |

* cited by examiner

IMPACT-ABSORBING ANCHORING ASSEMBLY FOR PROTECTIVE BARRIER

BACKGROUND OF THE INVENTION

Protective barriers are used to protect structures from collisions, to control access to certain areas and/or to direct a flow of traffic. Examples of different types of protective barriers include bollards, corner guards, and post-mounted railings. Depending on the particular application, a protective barrier such as a bollard may be surface-mounted or mounted via core-drilling. Core-drilled bollards are typically used in high impact applications such as protecting a loading dock from heavy vehicles, and are generally permanently mounted to the ground by embedding a portion of the bollard in a concrete-filled hole. Installation of a core-drilled bollard is significantly more expensive than for a surface-mounted bollard, and takes significantly more time. On the other hand, surface-mounted bollards are typically used in less demanding applications such as an in-store environment in which a bollard is used to protect product display cabinets. Surface-mounted bollards include a steel plate and a bollard supported on the plate so as to extend perpendicularly relative to the surface. The plate rests on the surface of the floor and one or more anchors, such as bolts, are used to fasten the plate, and therefore the bollard, to the floor. For this type of bollard, there is no significant disruption to the ground or floor, other than the bolt holes, which are in some instances pre-drilled. However, although intended for relatively low-impact environments, surface-mounted bollards are frequently required to accommodate relatively large loads without being permanently damaged.

SUMMARY

In some aspects, a bollard assembly is provided that includes a bollard including an open end, and a load transfer member disposed in the bollard and including a base and a sidewall extending from the base, the base including an opening. The assembly also includes a shock absorber disposed within the load transfer member, the shock absorber including a through hole; and a fastener that extends through the base opening and shock absorber through hole. The fastener includes an end protruding from the bollard open end, and the fastener end is configured to secure the load transfer member to a support surface. The load transfer member adjoins the bollard so as to be disposed between the shock absorber and the bollard. The load transfer member is configured so that when an impact force is applied to the bollard, the force is transferred from the bollard to the shock absorber via the load transfer member.

In other aspects, a protective device assembly is provided that includes a load receiving member, a load transfer member configured to be secured to the load receiving member and including a base and a sidewall extending from the base, the base including an opening. The assembly also includes a shock absorber disposed within the load transfer member, the shock absorber including a through hole; and a fastener that extends through the base opening and shock absorber through hole. The fastener includes a fastener end protruding beyond an end of the load receiving member, and the fastener end is configured to secure the load receiving member to a support surface. The load transfer member adjoins the load receiving member so as to be disposed between the shock absorber and the load receiving member. The load transfer member is configured so that when an impact force is applied to the load receiving member, the force is transferred from the load receiving member to the shock absorber via the load transfer member.

In still other aspects, an impact-absorbing anchoring assembly for surface-mounting a protective device to a ground surface is provided. The anchoring assembly includes a load transfer member configured to be secured to the protective device and including a base and a sidewall extending from the base, the base including an opening. The anchoring assembly includes a shock absorber disposed within the load transfer member, the shock absorber including a through hole. In addition, the anchoring assembly includes a fastener that extends through the base opening and shock absorber through hole, the fastener including an end protruding from the protective device, the fastener end configured to secure the assembly to a support surface. The load transfer member adjoins the protective device so as to be disposed between the shock absorber and a surface of the protective device. In addition, the load transfer member is configured so that when an impact force is applied to the protective device, the force is transferred from the protective device to the shock absorber via the load transfer member.

The bollard assembly, protective device assembly and anchoring assembly may include one or more of the following features: The load transfer member base is aligned with an end of the protective device, for example the bollard open end. The load transfer member base is aligned with an end of the protective device, for example the bollard open end, and the load transfer member sidewall faces an interior surface of the bollard. The fastener comprises an anchor, the anchor including a head and a threaded shank extending from the head, the shank having an outer diameter that is smaller than that of the head. The assembly further includes an annular load ring disposed on the shank so as to be disposed between a side of the shock absorber and the head. The shock absorber is disposed between the load transfer member base and the load ring. The assembly further includes an annular load ring disposed within the load transfer member on a side of the shock absorber that is opposed to the load transfer member base. The protective device, for example the bollard, is secured to the load transfer member. The bollard further includes a bollard sidewall, and the bollard sidewall is secured to the load transfer member sidewall. The bollard sidewall is secured to the load transfer member sidewall at a location that is axially spaced apart from the shock absorber. The axial length of the shock absorber is less than the axial length of the load transfer member. The shock absorber is disposed within the load transfer member so as to abut the load transfer member base. The shock absorber is an annular member formed of an elastic material. The shock absorber is an annular member having an outer diameter that corresponds to an inner diameter of the load transfer member. The protective device, for example the bollard, and load transfer member are rigid. The outer diameter of the load transfer member base corresponds to the inner diameter of the bollard. The outer diameter of the load transfer member sidewall at a location that is axially spaced from the load transfer member base is less than that of the inner diameter of the bollard whereby a gap exists between the load transfer member sidewall and the bollard at that location. The load transfer member is a cup. The bollard is secured to the load transfer member, and the bollard and load transfer member together are movable relative to the fastener.

Advantageously, the protective device includes an impact absorbing mechanism that transfers an impact load applied to the protective device to a shock absorber so that the applied load is substantially isolated from the device anchor. Instead, due to the resiliency of the shock absorber, the protective device and a load transfer member are permitted to deflect relative to the anchor upon application of the impact load, and then return to their original orientation. Also due to the resiliency of the shock absorber, the protective device may be prevented from being damaged by the impact load, contributing to the ability of the device and load transfer member to return to their pre-impact orientation.

Modes for carrying out the present invention are explained below by reference to an embodiment of the present invention shown in the attached drawings. The above-mentioned object, other objects, characteristics and advantages of the present invention will become apparent from the detailed description of the embodiment of the invention presented below in conjunction with the attached drawings.

DETAILED DESCRIPTION

Figure 1A:
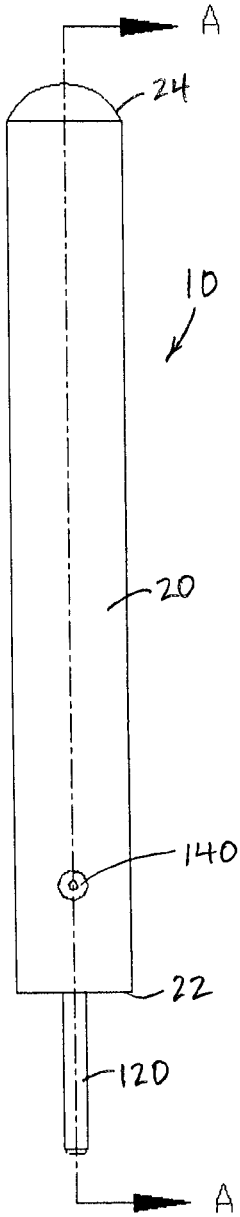
FIG. 1A is a side view of a bollard assembly.
Figure 1B:
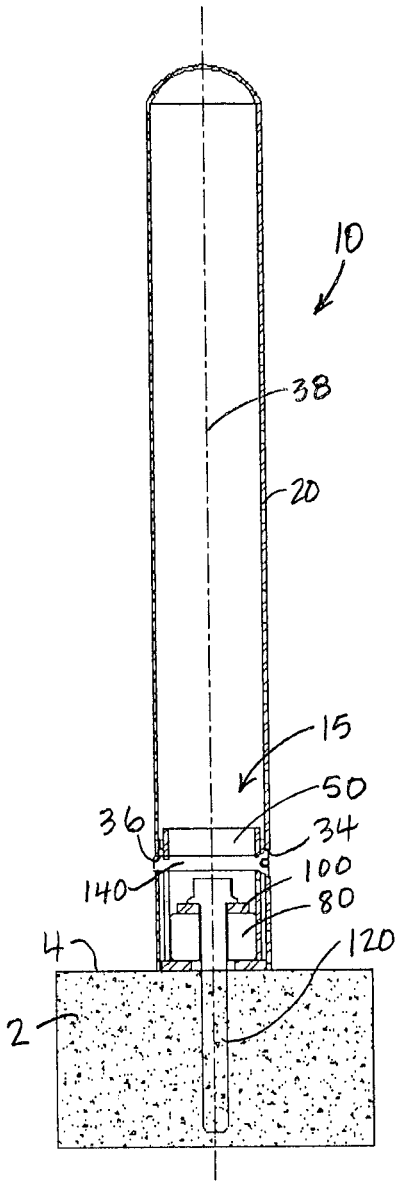
FIG. 1B is a sectional view of the bollard assembly of FIG. 1A as seen along line A-A and installed on a ground surface.
Figure 2:
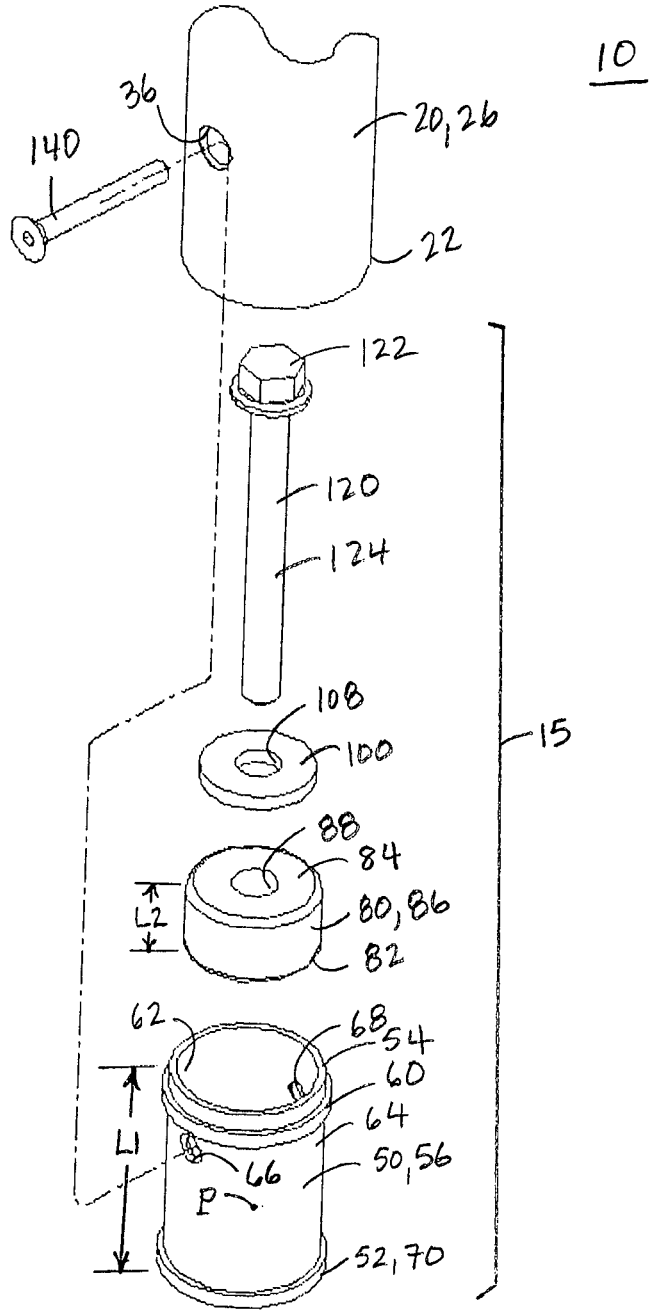
FIG. 2 is an exploded perspective view of the bollard assembly.
Figure 3:
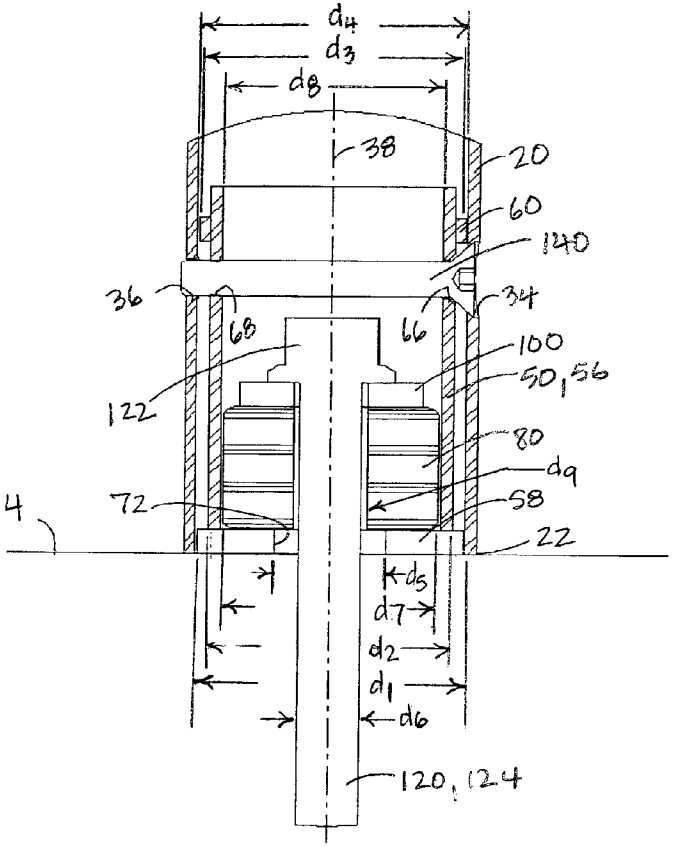
FIG. 3 is an enlarged sectional view of the bollard assembly base under no impact load.

Referring now to FIGS. 1-3, a surface-mounted protective device 10 is secured to a ground surface 4 using an impact-absorbing anchoring assembly 15. In the illustrated embodiment, the protective device 10 is a bollard 20 that is secured to a ground surface 4 using the anchoring assembly 15. The anchoring assembly 15 includes a load transfer member 50 configured to be received in an interior space of the bollard 20. The load transfer member 50 is secured to a surface 4 of the ground 2 using an anchor 120, and the load transfer member 50 and anchor 120 together secure the bollard 20 to the ground in a desired orientation, as described further below. For example, in the illustrated embodiment, the bollard 20 is oriented so that its longitudinal axis 38 extends in a direction generally normal to the ground surface 4. The anchoring assembly 15 also includes a resilient shock absorber 80 disposed in the load transfer member 50 so as to reside between the load transfer member 50 and the anchor 120. These and other features will be discussed in detail below.

Referring in particular to FIG. 2, the bollard 20 is a cylindrical tube that has a first end 22, a second end 24 opposed to the first end, and a sidewall 26 extending between the opposed ends 22, 24. The first end 22 is open, and in use is generally resting on the ground surface 4. The second end 24 is closed, and in the illustrated embodiment, the second end 24 is convex to promote shedding of moisture and to prevent the accumulation of debris on the protective device 10.

The bollard sidewall 26 includes a pair of diametrically-opposed through holes 34, 36 located adjacent to the bollard first end 22. More specifically, the bollard sidewall through holes 34, 36 are spaced apart from the bollard first end 22 a distance that is less than the axial length L1 of the load transfer member 50. The through holes 34, 36 are threaded and dimensioned to receive a fastener 140, such as a bolt, that is used to secure the bollard 20 to the load transfer member 50, as discussed further below.

The bollard sidewall 26 is thin relative to an outer diameter of the bollard 20. For example, in some embodiments, the bollard sidewall thickness may be 0.134 inches, and the outer diameter of the bollard 20 may be in a range of 1 inch to 5 inches. In addition, in some embodiments, the bollard has a length from first end 22 to second end 24 of 32 inches. It is understood that these dimensions are provided to give a general scale of the bollard 20, and that the provided dimensions are not limiting.

The bollard 20 may be formed of a tough, rigid material such as stainless steel. It will be understood that the bollard 20 is not limited to stainless steel, and may be formed of other rigid materials, including but not limited to, aluminum, mild steel, nylon, high density polyethylene, low density polyethylene, medium density polyethylene or polypropylene. Although not illustrated, the bollard outer surface may include surface features that enhance aesthetics and/or improve bollard visibility.

Referring particularly to FIGS. 2 and 3, the load transfer member 50 has a first end 52, an open second end 54 opposed to the first end 52, and a sidewall 56 extending between the opposed ends 52, 54. The first end 52 is closed by a load transfer member base 58 having a slightly larger outer diameter d1 than the outer diameter d2 of the load transfer member sidewall 56. In the illustrated embodiment, the load transfer member 50 is in the form of a cylindrical cup.

The outer surface 64 of the load transfer member 50 further includes a protruding circumferentially-extending bead 60 located closely adjacent to the load transfer member second end 54. The bead 60 may be formed integrally with the member sidewall 56, or may be formed as a separate annular ring that is fixed to the member sidewall 56, for example by welding. The outer diameter d3 of the bead 60 corresponds to the outer diameter d1 of the load transfer member base 58. When the load transfer member 50 is assembled within the bollard 20, the base 58 is aligned with the bollard first end 22, and the load transfer member second end resides within the bollard 20. In use, the base 58, like the bollard first end 52, is generally resting on the ground surface 4. The load transfer member base outer diameter d1 and the bead outer diameter d3 are dimensioned to generally correspond to, or be slightly less than, the inner diameter d4 of the bollard 20. As a result, the load transfer member 50 is nested in a fitted manner within the open end 22 of the bollard 20.

The load transfer member base 58 includes a central opening 72 that is dimensioned to receive a shank 124 of the anchor 120 therethrough. More specifically, the diameter d5 of the load transfer member central opening 74 is greater than the outer diameter d6 of the anchor shank 124 to permit some slight movement of the load transfer member 50 relative to the anchor 120.

The load transfer member sidewall 56 includes a pair of diametrically-opposed through holes 66, 68 located adjacent to the load transfer member second end 54. Specifically, the load transfer member sidewall through holes 66, 68 are disposed between the load transfer member second end 54 and a midpoint P located midway between the load transfer member first and second ends 52, 54. More specifically, the load transfer member sidewall through holes 66, 68 are disposed between the bead 60 and the midpoint P. Each of the load transfer member sidewall through holes are dimensioned to receive the fastener 140 therethrough. When the load transfer member 50 is assembled within the bollard 20 with the base 58 aligned with the bollard first end 22, the load transfer member sidewall through holes 66, 68 can be aligned with the bollard sidewall through holes 34, 36. The fastener 140 is passed through the first bollard through-hole 34, through corresponding through holes 66, 68 formed in a sidewall 56 of the load transfer member 50, and engages threads formed in the second, opposed bollard through hole 68, whereby the bollard 20 is secured to the load transfer member 50.

The shock absorber 80 is an annular member formed of an elastomer such as rubber, poly urethane, or ethylene propylene diene Monomer (M-class) synthetic rubber (EPDM), and includes an axially-extending central opening 88. When the shock absorber 80 is assembled within in the load transfer member 50, a first end face 82 of the shock absorber 80 rests on an inner surface of the load transfer member base 58. The shock absorber 80 has an outer diameter d7 that corresponds to an inner diameter d8 of the load transfer member 50, so that the shock absorber outer surface 86 confronts and abuts the load transfer member inner surface 62. As a result, the load transfer member 50 and shock absorber 80 are co-axially arranged, and the shock absorber central opening 88 is aligned with the load transfer member central opening 72. In addition, the shock absorber 80 has an axial length L2 that is less than half the load transfer member axial length L1. In the illustrated embodiment, the shock absorber axial length L2 is about one-third of the load transfer member axial length L1.

The shock absorber 80 is retained within the load transfer member 50 by securing it with the anchor 120, which includes a head 122, and the threaded shank 124 which has an outer diameter d6 that is smaller than that of the head 122. The shock absorber central opening 88 has a diameter that corresponds to, and/or is slightly larger than, the shank outer diameter d6.

In addition, an annular load ring 100 is disposed on the anchor shank 124 between the shank head 122 and a second end face 84 of the shock absorber 80. The load ring 100 serves to distribute forces seen at the interface between the shock absorber second end face 84 and the bolt head 122. The load ring 100 is formed of a tough, rigid material such as stainless steel, and has a thickness that is sufficient to prevent deformation upon impact loading of the protective device 10.

In use, the shock absorber 80 and load ring 100 are assembled on the anchor shank 124, and the shank 120 extends within the load transfer member 50 and through the load transfer member central opening 72 so that so that the anchor head 122, load ring 100 and shock absorber 80 reside within the load transfer member 50, and so that the load ring 100 is disposed between the shock absorber 80 and the anchor head 122. The portion of the shank 124 that extends out of the load transfer member 50 includes anchor threads 126 that engage the ground 2, whereby the load transfer member 50 is secured to the ground surface 4. In addition, the anchor 120 is tightened, for example by rotation of the anchor 120 relative to the ground 2, to an extent that a slight axial compressive load is applied to the shock absorber 80 via the anchor head 122 and load ring 100, whereby the load transfer member 50 is firmly secured to the ground surface 4. The bollard 20 is then assembled on the outer surface 64 of the load transfer member 50 so that the first end 22 of the bollard 20 rests on the ground surface 4 and lies flush with the first end 52 of the load transfer member 50. The bollard 20 is secured to the load transfer member 50 using the fastener 140 as discussed above.

Figure 4:
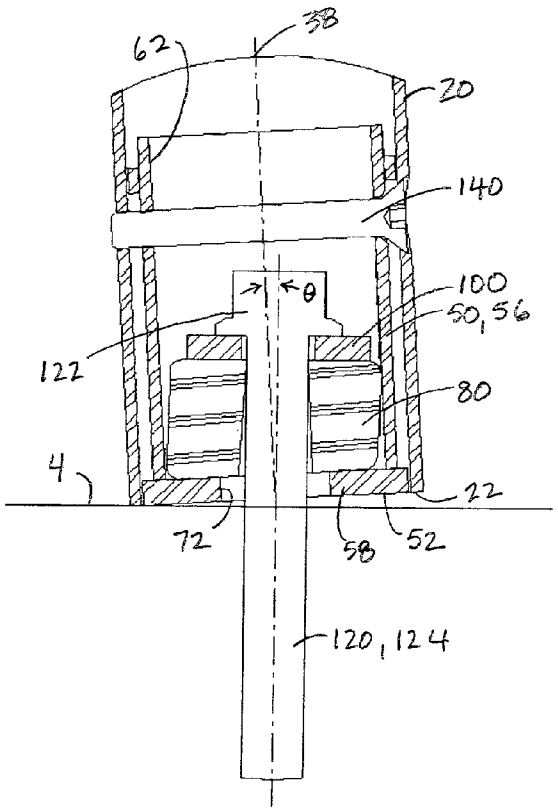
FIG. 4 is an enlarged sectional view of the bollard assembly of FIG. 3 under an impact load.

Referring to FIG. 4, upon application of an impact load to the sidewall 26 of the bollard 20, the impact load is transferred from the bollard sidewall 26 to the load transfer member sidewall 56 due to the closely arranged configuration of these components. In addition, since the shock absorber 80 is disposed within the load transfer member 50 between the load transfer member inner surface 62 and the anchor shank 124, the impact load is transferred from the load transfer member 50 to the shock absorber 80. The resilience of the shock absorber 80 permits it to absorb the impact load so that the anchor 120 receives a greatly-reduced load, and possibly no load, due to the impact force. For relatively large impact loads, it is possible for the bollard sidewall and load transfer member to be deflected by the impact load away from a normal orientation, such that the longitudinal axis 38 of the bollard 20 rotates to an angle θ relative to the normal. The deflection is absorbed by the shock absorber 80 so that the anchor 120 remains un-deformed and the ground 2 remains undamaged. Moreover, due to the resilience of the shock absorber 80, the bollard 20 and load transfer member 50 are returned to a normal, upright orientation upon withdrawal of the impact load.

Figure 6:
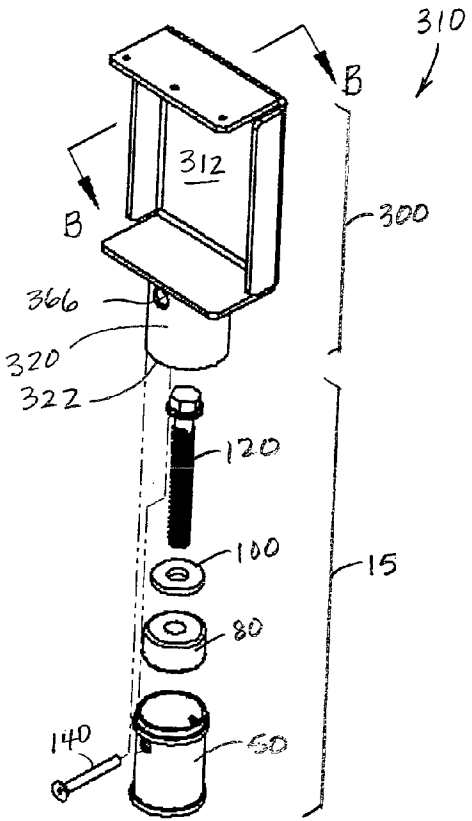
FIG. 6 is an exploded view of the railing system of FIG. 5.
Figure 5:
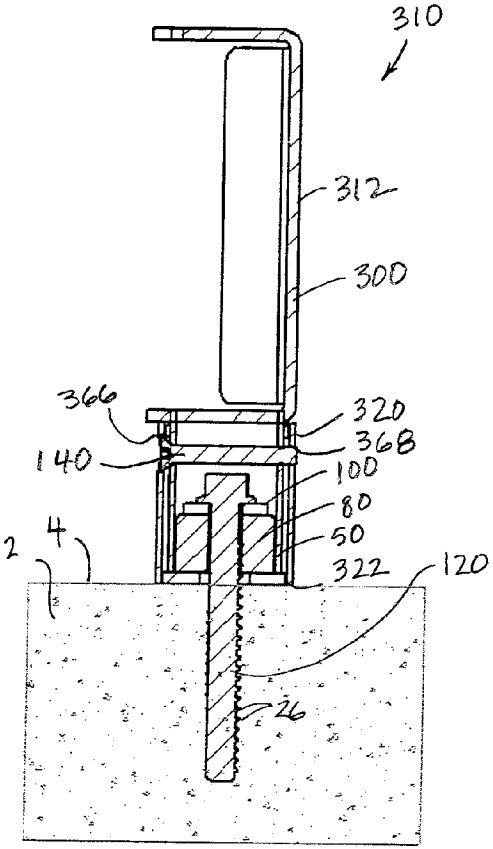
FIG. 5 is a sectional view of a railing system as seen along line B-B of FIG. 6 and installed on a ground surface.

Referring to FIGS. 5 and 6, an alternative embodiment surface-mounted protective device 310 is secured to a ground surface 4 using the impact-absorbing anchoring assembly 15. In this embodiment, the protective device 310 is a railing system. The railing support post 300 is shown, which is configured to support a horizontally-extending rail (not shown). The support post 300 includes a generally U-shaped upper portion 312 that is configured to receive and support the rail, and a tubular lower portion 320 that extends from the upper portion 310 and includes an open end 322. The railing support post 300 is secured to a ground surface 4 using the anchoring assembly 15.

As in the previous embodiment, the anchoring assembly 15 includes the load transfer member 50 disposed in an interior space of the support post's tubular lower portion 320. The shock absorber 80 and load ring 100 are assembled on the anchor shank 124, and the shank 120 extends within the load transfer member 50 and through the load transfer member central opening 72 so that the anchor head 122, load ring 100 and shock absorber 80 reside within the load transfer member 50, and so that the load ring 100 is disposed between the shock absorber 80 and the anchor head 122. The portion of the shank 124 that extends out of the load transfer member 50 includes anchor threads 126 that engage the ground 2, whereby the load transfer member 50 is secured to the ground surface 4. In addition, the anchor 120 is tightened, for example by rotation of the anchor 120 relative to the ground 2, to an extent that a slight axial compressive load is applied to the shock absorber 80 via the anchor head 122 and load ring 100, whereby the load transfer member 50 is firmly secured to the ground surface 4. The railing support post 300 is assembled on the outer surface 64 of the load transfer member 50 so that the open end 322 of the support post 300 rests on the ground surface 4 and lies flush with the first end 52 of the load transfer member 50. The tubular lower portion 320 includes through holes 366, 368, and the tubular lower portion 320 is secured to the load transfer member 50 using the fastener 140 in the same manner as the bollard 20.

The railing support post 300, when mounted on the impact-absorbing anchoring assembly 15, functions identically to the bollard assembly of FIGS. 1-4 under impact loading. That is, upon application of an impact load to the support post 300 either directly or via the rail, the impact load is transferred from the support post 300 to the load transfer member sidewall 56 due to the closely arranged configuration of these components. In addition, since the shock absorber 80 is disposed within the load transfer member 50 between the load transfer member inner surface 62 and the anchor shank 124, the impact load is transferred from the load transfer member 50 to the shock absorber 80. The resilience of the shock absorber 80 permits it to absorb the impact load so that the anchor 120 receives a greatly-reduced load, and possibly no load, due to the impact force. Deflections of the support post 300 from an upright orientation are absorbed by the shock absorber 80 so that the anchor 120 remains un-deformed and the ground 2 remains undamaged. Moreover, due to the resilience of the shock absorber 80, the support post 300 and load transfer member 50 are returned to a normal, upright orientation upon withdrawal of the impact load.

Although use of a shock-absorbing anchoring assembly 15 has been described above with application to a bollard 20 and a railing support post 300, it is understood that this feature could be adapted to other surface-mounted protective devices such as corner guards.

In addition, in the illustrated embodiments, the load transfer member 50 is in the form of a cylindrical cup, but it will be understood that the member is not limited to this configuration. The shape of the sidewall 56 corresponds to the shape of the protective device with which it is being used so that an impact load can be efficiently transferred to the load transfer member 50. As such, the load transfer member 50 can be non-cylindrical and/or non-tubular if required by the particular application.

A selected illustrative embodiment of the invention is described above in some detail. It should be understood that only structures considered necessary for clarifying the present invention have been described herein. Other conventional structures, and those of ancillary and auxiliary components of the system, are assumed to be known and understood by those skilled in the art. Moreover, while a working example of the present invention has been described above, the present invention is not limited to the working example described above, but various design alterations may be carried out without departing from the present invention as set forth in the claims.

What is claimed is:

1. A bollard assembly comprising:

a bollard including an open end;

a load transfer member disposed in the bollard and including a base and a sidewall extending from the base, the base including an opening and having an outer diameter corresponding to the inner diameter of the bollard, a shock absorber disposed within the load transfer member, the shock absorber including a through hole; and a fastener that extends through the base opening and shock absorber through hole, the fastener including an end protruding from the bollard open end, the fastener end configured to secure the load transfer member to a support surface, and the load transfer member adjoining the bollard so as to be disposed between the shock absorber and the bollard, the load transfer member configured so that when an impact force is applied to the bollard, the force is transferred from the bollard to the shock absorber via the load transfer member.

2. The bollard assembly of claim 1 wherein the load transfer member base is aligned with the bollard open end.

3. The bollard assembly of claim 1, wherein the load transfer member base is aligned with the bollard open end, and the load transfer member sidewall faces an interior surface of the bollard.

4. The bollard assembly of claim 1, wherein the fastener comprises an anchor, the anchor including a head and a threaded shank extending from the head, the shank having an outer diameter that is smaller than that of the head.

5. The bollard assembly of claim 4, further comprising an annular load ring disposed on the shank so as to be disposed between a side of the shock absorber and the head.

6. The bollard assembly of claim 5, wherein the shock absorber is disposed between the load transfer member base and the load ring.

7. The bollard assembly of claim 1 further comprising an annular load ring disposed within the load transfer member on a side of the shock absorber that is opposed to the load transfer member base.

8. The bollard assembly of claim 1 wherein the bollard is secured to the load transfer member.

9. The bollard assembly of claim 1 wherein the bollard further includes a bollard sidewall, and the bollard sidewall is secured to the load transfer member sidewall.

10. The bollard assembly of claim 9 wherein the bollard sidewall is secured to the load transfer member sidewall at a location that is axially spaced apart from the shock absorber.

11. The bollard assembly of claim 1 wherein the axial length of the shock absorber is less than the axial length of the load transfer member.

12. The bollard assembly of claim 1 wherein the shock absorber is disposed within the load transfer member so as to abut the load transfer member base.

13. The bollard assembly of claim 1 wherein the shock absorber is an annular member formed of an elastic material.

14. The bollard assembly of claim 1 wherein the shock absorber is an annular member having an outer diameter that corresponds to an inner diameter of the load transfer member.

15. The bollard assembly of claim 1 wherein the bollard and load transfer member are rigid.

16. The bollard assembly of claim 1 wherein the outer diameter of the load transfer member sidewall at a location that is axially spaced from the load transfer member base is less than that of the inner diameter of the bollard whereby a gap exists between the load transfer member sidewall and the bollard at that location.

17. The bollard assembly of claim 1 wherein the load transfer member is a cup.

18. The bollard assembly of claim 1 wherein the bollard is secured to the load transfer member, and the bollard and load transfer member together are movable relative to the fastener.

19. A protective device assembly comprising:

a load receiving member;

a load transfer member configured to be secured to the load receiving member and including a base and a sidewall extending from the base, the base including an opening and having an outer diameter corresponding to an inner diameter of a portion of the load receiving member, a shock absorber disposed within the load transfer member, the shock absorber including a through hole; and a fastener that extends through the base opening and shock absorber through hole, the fastener including a fastener end protruding beyond an end of the load receiving member, the fastener end configured to secure the load receiving member to a support surface, and the load transfer member disposed adjoining the load receiving member so as to be disposed between the shock absorber and the load receiving member, the load transfer member configured so that when an impact force is applied to the load receiving member, the force is transferred from the load receiving member to the shock absorber via the load transfer member.

20. The protective device assembly of claim 19, wherein the fastener comprises an anchor, the anchor including a head and a threaded shank extending from the head, the shank having an outer diameter that is smaller than that of the head.

21. The protective device assembly of claim 20, further comprising an annular load ring disposed on the shank so as to be disposed between a side of the shock absorber and the head.

22. The protective device assembly of claim 21, wherein the shock absorber is disposed between the load transfer member base and the load ring.

23. The protective device assembly of claim 19 further comprising an annular load ring disposed within the load transfer member on a side of the shock absorber that is opposed to the load transfer member base.

24. The protective device assembly of claim 19 wherein the load receiving member is secured to the load transfer member.

25. The protective device assembly of claim 19 wherein the axial length of the shock absorber is less than the axial length of the load transfer member.

26. The protective device assembly of claim 19 wherein the shock absorber is an annular member formed of an elastic material.

27. The protective device assembly of claim 19 wherein the shock absorber is an annular member having an outer diameter that corresponds to an inner diameter of the load transfer member.

28. The protective device assembly of claim 19 wherein the load receiving member and load transfer member are rigid.

29. The protective device assembly of claim 19 wherein the load transfer member is a cup.

30. The protective device assembly of claim 19 wherein the load receiving member is secured to the load transfer member, and the load receiving member and load transfer member together are movable relative to the fastener.

31. An impact-absorbing anchoring assembly for surface-mounting a protective device to a support surface, the assembly comprising:

a load transfer member configured to be secured to the protective device and including a base and a sidewall extending from the base, the base including an opening and having an outer diameter corresponding to an inner diameter of the protective device, a shock absorber disposed within the load transfer member, the shock absorber including a through hole; and a fastener that extends through the base opening and shock absorber through hole, the fastener including an end protruding from the protective device, the fastener end configured to secure the assembly to the support surface, and the load transfer member adjoining the protective device so as to be disposed between the shock absorber and a surface of the protective device, the load transfer member configured so that when an impact force is applied to the protective device, the force is transferred from the protective device to the shock absorber via the load transfer member.

32. The impact-absorbing anchoring assembly of claim 31, wherein the fastener comprises an anchor, the anchor including a head and a threaded shank extending from the head, the shank having an outer diameter that is smaller than that of the head.

33. The impact-absorbing anchoring assembly of claim 32, further comprising an annular load ring disposed on the shank so as to be disposed between a side of the shock absorber and the head.

34. The impact-absorbing anchoring assembly of claim 33, wherein the shock absorber is disposed between the load transfer member base and the load ring.

35. The impact-absorbing anchoring assembly of claim 31 further comprising an annular load ring disposed within the load transfer member on a side of the shock absorber that is opposed to the load transfer member base.

36. The impact-absorbing anchoring assembly of claim 31 further comprising the protective device, wherein the protective device is secured to the load transfer member.

37. The impact-absorbing anchoring assembly of claim 31 wherein the axial length of the shock absorber is less than the axial length of the load transfer member.

38. The impact-absorbing anchoring assembly of claim 31 wherein the shock absorber is an annular member formed of an elastic material.

39. The impact-absorbing anchoring assembly of claim 31 wherein the shock absorber is an annular member having an outer diameter that corresponds to an inner diameter of the load transfer member.

40. The impact-absorbing anchoring assembly of claim 36 wherein the protective device and load transfer member are rigid.

41. The impact-absorbing anchoring assembly of claim 31 wherein the load transfer member is a cup.

42. The impact-absorbing anchoring assembly of claim 36 wherein the protective device is secured to the load transfer member, and the protective device and load transfer member together are movable relative to the fastener.

* * * * *